US009004503B2

(12) United States Patent
Sorenson

(10) Patent No.: US 9,004,503 B2
(45) Date of Patent: Apr. 14, 2015

(54) ROTATABLE BINDING SYSTEM FOR SNOWBOARDS

(71) Applicant: Kurt Bryce Sorenson, Albuquerque, NM (US)

(72) Inventor: Kurt Bryce Sorenson, Albuquerque, NM (US)

(73) Assignee: Snowboard Sport Solutions, LLC, Albuquerque, NM (US)

( * ) Notice: Subject to any disclaimer, the term of this patent is extended or adjusted under 35 U.S.C. 154(b) by 157 days.

(21) Appl. No.: 13/679,323

(22) Filed: Nov. 16, 2012

(65) Prior Publication Data

US 2014/0138935 A1 May 22, 2014

(51) Int. Cl.

| | |
|---|---|
| ***B62B 9/04*** | (2006.01) |
| ***A63C 9/081*** | (2012.01) |
| ***A63C 10/14*** | (2012.01) |
| ***A63C 10/16*** | (2012.01) |
| ***A63C 10/18*** | (2012.01) |

(52) U.S. Cl.

CPC ..... *A63C 10/14* (2013.01); *A63C 10/16* (2013.01); *A63C 10/18* (2013.01); *A63C 2203/54* (2013.01)

(58) Field of Classification Search

CPC ..... A63C 1/00; A63C 10/02; A63C 10/08; A63C 10/10; A63C 10/12; A63C 10/14; A63C 10/145; A63C 10/16; A63C 10/18; A63C 10/20; A63C 2203/54; A63C 9/00; A63C 9/003; A63C 9/02; A63C 9/08; A63C 9/081; A63C 9/082; A63C 9/084; A63C 9/085

USPC ..... 280/611, 613, 628, 618, 14.24, 14.22, 280/626

See application file for complete search history.

(56) References Cited

U.S. PATENT DOCUMENTS

| | | | | |
|---|---|---|---|---|
| 3,834,723 | A | 9/1974 | Erlebach | |
| 4,027,896 | A | 6/1977 | Frechin et al. | |
| 4,165,887 | A | 8/1979 | Bunn, Jr. | |
| 5,584,492 | A | 12/1996 | Fardie | |
| 5,667,237 | A | 9/1997 | Lauer | |
| 5,813,689 | A | 9/1998 | Mansure | |
| 5,855,390 | A | 1/1999 | Hassell | |
| 5,901,975 | A | 5/1999 | Phipps | |
| 6,155,591 | A * | 12/2000 | Huffman et al. | 280/618 |
| 6,318,749 | B1 * | 11/2001 | Eglitis et al. | 280/607 |
| 6,491,310 | B1 * | 12/2002 | Work | 280/14.24 |
| 6,994,370 | B2 * | 2/2006 | Sabol | 280/618 |
| 7,059,614 | B2 | 6/2006 | Cole, III | |
| 7,815,214 | B2 * | 10/2010 | Sabol | 280/618 |
| 7,837,219 | B1 * | 11/2010 | Cordes | 280/618 |
| 8,276,921 | B2 * | 10/2012 | Walker | 280/14.24 |

(Continued)

*Primary Examiner* — J. Allen Shriver, II
*Assistant Examiner* — James M Dolak
(74) *Attorney, Agent, or Firm* — Luis M. Ortiz; Kermit D. Lopez; Ortiz & Lopez, PLLC

(57) ABSTRACT

A binding system for snowboards that minimizes leg pain while snowboard users are approaching or are riding on a chairlift. The rotatable binding system enables one of two boot bindings attached to a snowboard to rotate up to 90 degrees placing a user's boot in parallel with the long sides, and sliding direction, of the snowboard. The binding system includes a base plate, which is fixed to the snowboard, and a top plate that is rotatably attached to the base plate by a center screw, and a boot binding harness mounted to the top plate. A hinge plate can connect the base plate to a mid static disk, which can in turn rotatably attach to the top plate. The binding system can include a latch lever that acts as a hands-free locking system that is mounted through an outer ridge of the base plate and connected to a retractable plunger.

17 Claims, 7 Drawing Sheets

(56) References Cited

U.S. PATENT DOCUMENTS

| | | | | |
|---|---|---|---|---|
| 8,317,218 | B2 * | 11/2012 | Furr et al. | 280/618 |
| 8,371,591 | B2 * | 2/2013 | Hwongbo | 280/14.24 |
| 8,376,390 | B2 * | 2/2013 | Neiley et al. | 280/618 |
| 8,596,668 | B2 * | 12/2013 | Van Bregmann, Jr. | 280/618 |
| 8,870,212 | B2 * | 10/2014 | Noyes et al. | 280/612 |
| 8,894,075 | B2 * | 11/2014 | Walker | 280/14.24 |
| 2004/0188983 | A1 * | 9/2004 | Scholten | 280/618 |
| 2005/0194753 | A1 | 9/2005 | Craven, Jr. et al. | |
| 2008/0277904 | A1 * | 11/2008 | Etges | 280/613 |

* cited by examiner

ROTATABLE BINDING SYSTEM FOR SNOWBOARDS

The present application is a continuation of and claims priority to U.S. application Ser. No. 12/433,380, entitled "HINGED ROTATABLE BINDING SYSTEM FOR SNOWBOARDS", filed Apr. 30, 2009, which is also a continuation of provisional patent application 61/049,390, filed Apr. 30, 2008. Both prior applications are herein incorporated by reference.

TECHNICAL FIELD

Embodiments are generally related to snowboards. Embodiments are particularly related to a rotatable binding system for snowboards. Embodiments are further related to hinged, rotatable binding systems for snowboards.

BACKGROUND OF THE INVENTION

Snowboarding has been one of the fastest growing sport since 1997 and has become a competitive winter sport in the United States and other countries. It is usually done on commercially operated slopes, which are designed to accommodate many skiers and snowboarders. Snowboarding is only similar to skiing in that it requires a person to slide downhill on top of snow, but it is more like surfing and skateboarding in style and form, and because only a single board is used to traverse the snow by a snowboarder. Market research statistics during the period 1990-2004 have shown that the overall snowboarding population increased by 294 percent during this period (i.e., an average increase of 20% per year). Another statistics for this period (2004-2005) shows that 6.6 million tickets were sold to snowboarders. These statistics reveal vast growth and popularity of the snowboarding sport on the younger generations.

Snowboarding is a sport that involves descending a snow-covered slope with both feet strapped to a single board, a "snowboard". Snowboard bindings attach both of a user's feet about shoulder width apart to a single board using special boots held within a snowboard-mounted binding system, and the snowboarder is standing on a snowboard perpendicular to the snowboard's direction of travel.

A snowboarder uses boots designed especially for the requirements of snowboarding. As with skiing, snowboarding requires that boots be secured to a snowboard by boot binding straps; however, what is very different between skiing and snowboarding is that both feet are secured to a single snowboard, compared to skiing where each foot is attached to its own ski by a damping system. Movements of participant of the two downhill winter sports are also vastly and noticeably different.

As with skiing, snowboarding generally involves the use of chair lifts to carry snowboarders from a base to a summit. At each lift there will be a line of skiers and snowboarders waiting to board the chairlift. Snowboarders experience a burden not experienced by skiers while shuffling over to the chairlift on foot because one foot (the leading foot) remains tied to the snowboard, while the other foot (rear trailing foot) is used to push the user via the snowboard over to the chairlift (similar to how a skateboarder moves himself on a skateboard). Moving while one foot is tied to a snowboard at almost a ninety-degree angle with respect to the direction of travel can be fatiguing, painful, and unattractive given the user's odd attachment by a single foot to their snowboards. By comparison, a skier never removes a boot from a ski binding while moving through a chair lift line.

It is important to reiterate that other than sliding downhill on snow, snowboarding differs significantly from skiing, both in form and in technology. In snowboarding, rather than having separate skis for each foot and poles for each hand, both feet of a snowboarder are held, one in front of the other (or side by side with shoulder width separation), on a single, relatively wide board using a binding system including two boot bindings fixed to the top surface of the snowboard. The primary purpose of the binding system for snowboards is to hold both of the user's boots onto a snowboard during a snowboarder's use of the snowboard on ski slopes. Besides that, the binding system must provide adaptability to various shoe sizes and adjustability of the angle of the boots to the longitudinal axis of the snowboard.

The general construction of a snowboard involves some basic components. Components and features of a snowboard include its core, a top surface, the base or bottom surface, first and second ends (typically upturned and often referred to as a "nose" and a "tail"), and sharp edges along each of the long edges of the snowboard. A core is typically the interior construction of the snowboard. The base is typically the bottom of a board that makes contact with the snow. The long edges of the snowboard can include a strip of metal, tuned normally to just less than 90° that runs the length of either side of the board. The top surface is where the binding system is mounted and is the area that directly supports and secures both feet of a snowboarder (a person) onto the top of a snowboard.

The snowboard can be a thin, slightly hourglass-shaped board that can be ridden down ski runs. Snowboards generally have a length between 140-165 cm and a width from about 24 up to 27 cm or more (dimension that are much shorter, yet much wider than snow skies). The size variants are meant to accommodate many varieties of people, skill levels, snow types, and riding styles. The snowboards are usually constructed with a laminated wood core sandwiched between multiple layers of fiberglass. The bottom or 'base' of the snowboard can generally be made of various materials including plastic or coated wood, and can be surrounded by a thin strip of steel as the 'edge'. The top surface layer can include printed graphics and can be coated with an acrylic. Bindings are separate components from the snowboard that are mounted to the top surface (e.g., or "deck"), though they are a very important part of the total snowboard interface. The main function of bindings is to hold the riders boots (and both feet) in place tightly onto the snowboard so the rider can manipulate and transfer their energy to the snowboard while traveling downhill over snow.

A chairlift is a type of aerial lift, which comprises of a continuously circulating steel cable loop strung between two end terminals and usually over intermediate towers, carrying a series of chairs. A chair-lift is a transports system generally used to travel across a mountain side along various posts.

Passengers moving towards for boarding or traveling on a chair lift need to take necessary precautions to avoid injuries. When the passengers are in a stance position and shuffling towards a chair lift for a ride, they need to adjust the bindings accordingly to alleviate pain in ankles and knees. Snowboards can generally provide up to 45° rotation between the toe areas of each of the bindings that are mounted on a snowboard. The binding positions, however, remain fixed once set. The binding position associated in such snowboards can be painful and uncomfortable while a snowboarder is moving along in lift lines and while riding on a chair lift. The stance of the user may look awkward and unnatural. Ideally, bindings would be adjustable in order to alleviate pain in the snowboarder's knee, ankles, and legs because a snowboard remains tethered to a snowboarder's foot while the snowboarder is dealing with chairlift line maneuvering and chairlift usage.

The present inventor has created a snowboard binding that can be rotated temporarily in order to alleviate pain experienced in a user's foot and leg as the user's foot remains tethered to the snowboard during chairlift approach or while standing in chairlift lines, and that can also be hinged from dangling snowboards from a user's leg while the user is riding a chairlift. The majority of prior art binding systems do not focus on managing the impact of chairlift wind over a dangling snowboard and the load it causes on a user's foot. The lack of a hands-free locking and release system limits the capability of prior art snowboards. There is currently no rotatable binding system for the snowboards. Nonexistent is a system that can ease the load on a user's foot and ankle area while shuffling along in chairlift lines. Also, nonexistent is a system that can ease the load on a user's foot while a user is riding on a chairlift. Consequently, a snowboard's weight causes stress on knee and ankle and causes an awkward stance by snowboarders while they move along through chair lift lines. Similarly, the binding position while in lift lines and on the chair lift associated with such systems is painful and is a pulling force while tethered by a binding to the user which is unnatural for the lead ankle. The cascading effect typically results in a binding position that is painful and cumbersome for users while in lift lines as well as when riding on the chair lift.

If two users are sitting next to each other on a chairlift and they use opposite boots as their front boot, the twisting of theft legs due to their respective bindings can cause their snowboards to collide with each other. This is not only painful, but may also be dangerous. Similarly, getting off a chair lift can also be troublesome because the angle at which the user's leading foot (boot) on the snowboard and because the user is bound to the snowboard making it difficult for the user to position the snowboard in line with forward movement of the chair lift to the point of dismount from the chairlift by the snowboarder. If the snowboard is not positioned in a forward direction with movement of the chair lift as the snowboard touches the ground, the user can veer off to one side and run into the person next to the disembarking snowboarder who had been sharing the chair lift. Hence, an improved snowboard binding system is needed in order to provide greater safety and comfort for snowboarders while in lift lines and on the chair lift.

Based on the foregoing, it is believed that a need therefore exists for an improved snowboard binding system that eliminates rotation at the knee and flexion at the ankle, and which can be incorporated with a locking system that can be hands-free. It is also believed a need exists for the snowboard binding system to reduce discomfort and injury when approaching and mounting/dismounting from a chairlift,

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole while attempting to understand all the features of the present invention.

It is a feature of the present invention to provide an improved snowboarding binding system.

It is another feature of the present invention to provide an improved rotating binding system for snowboards.

It is a yet another feature of the present invention to provide an improved hands-free locking system for a snowboard rotatable binding system.

It is another feature of the present invention to provide for an improved snowboard binding system that will rotate the front binding to a parallel position for ease of mobility while moving forward through a chairlift line.

It is also a feature of the present invention to provide for an improved snowboard binding system that is incorporated with a hands free locking system.

The aforementioned features and other aspects and advantages can now be achieved without undue limitation as will be further described herein. A binding system for snowboards is described that minimizes leg pain while a user is moving towards a chair lift in a chair lift line or while riding on the chair lift. The binding system can include a base plate that is fixed to a top of a snowboard and a top rotating plate that is rotatably attached to the base plate and to which a boot binding harness can be attached. A hinge plate can also be provided that connects the base plate to the top plate. The binding system can include a latch as a locking mechanism that can be mounted at/through an outer ridge of the base plate and connected to a retractable plunger.

Screws or bolts can connect the base plate with the snowboard and their use herein can be interchangeable as fasteners for the purpose of connecting parts of the invention that are described herein. A central axis bolt (screw) can mount the top, rotating plate to the base plate. If included, a hinged plate of the rotatable binding system can be opened while user is riding the chairlift. The hinge plate can enable the snowboard to rotate away from user's foot that is attached to the top plate by a binding harness attached to the top plate. The base plate can be connected by a hinge plate to a mid static disk, and it is the mid static disk that can support rotating of the disk thereon.

The top plate can rotate up to 90° when the binding system is unlocked to alleviate pain in the ankle and the knee when the snowboarder is in lift lines or chair lift. The snowboard binding system can be referred to as a rotational, hinged system when hinging is also provided. According to the comfort of the user, the binding can be rotated to 90°, which alleviates torque and moments on the ankle while on the lift.

The materials used in the snowboard binding system can include non-corrosive, lightweight, strong, and durable metals.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the features disclosed herein.

DETAILED DESCRIPTION

The particular values and configurations discussed in these non-limiting examples can be varied and are cited merely to illustrate at least one embodiment and are not intended to limit the scope thereof.

There are general two types of snowboard binding boot harnesses used with a snowboard. A strap boot harness binding typically includes one or more straps that extend across the rider's boot to secure the boot to the binding. By contrast, step in boot harnesses typically employ one or more strapless engagement members, rather than straps, into which a rider can step down hard onto a boot binding to lock the boot into the binding via the strapless engagement members. The strapless engagement members are configured to engage with one or more corresponding engagement members on the boot. Some riders may find a strap binding inconvenient because a rider must unbuckle each strap of the rear binding after each run to release the rear boot when getting on a lift and must subsequently re-buckle each strap before the next run.

The problems associated with prior art binding systems, when moving on level areas, and into and through chair-lift lines, is that the snowboarder has to remove the trailing (back) foot from its binding, leaving the leading (forward) foot fixed into its binding in the transverse position, and then try to propel himself or herself on the snowboard along as if using a skateboard. With the forward foot locked in the pre-selected transverse position and the other foot out of the binding, even a casual observer can see the front foot (and thus the front leg) is contorted to one side, forcing the snowboarder to walk in an extremely pigeon-toed manner. This obviously results in undue stresses to the snowboarder's joints and body.

In addition, for the same reason, while the snowboarder is riding chair-lifts with other skiers, the snowboard tends to hang at a sideways angle rather than pointing straight forward in a position parallel with the skis worn by the other riders on the chair-lift. Here again, the snowboard often bangs into or onto the top of adjacent skis much to the discomfort of neighboring skiers on the same chairlift, and chipping and scratching of their equipment can and does occur. Such snowboard binding systems tend to look extremely uncomfortable, are cumbersome with the promotion of an awkward stance position, and are hard to maneuver. When snowboarders are moving along in chair-lift lines, or riding on chairlifts, their stance is an extremely awkward, pigeon-toed (transverse foot) positioning of their snowboard bound foot. Another problem with the snowboard binding systems is that they cause physical discomfort and can cause injury to the user. Snowboarders generally experience stress to their joints from undue torque and strain on their ankle and knees using current snowboard binding systems.

Figure 1A:
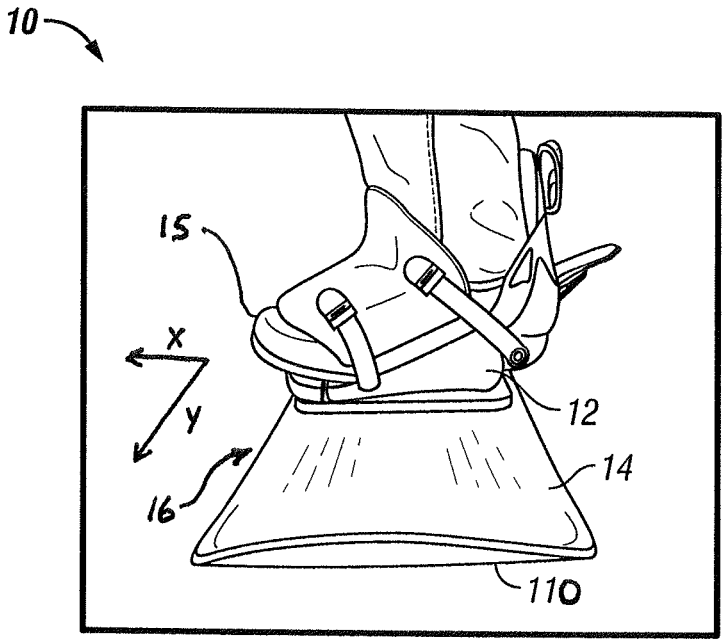
FIG. 1A (Prior Art)
FIGS. 1A and 1B, labeled as "Prior Art", illustrate a prior art implementation of a snowboard system.

Referring to the illustration 10 in FIG. 1A labeled as "Prior Art", the conventional orientation of a user's lead foot while contained in a snowboard boot 15 is positioned wherein toes are facing perpendicular (x) to the direction (y) of a long edge 16 (where there are two long edges on a snowboard) of a snowboard 110 while the user's boot 15 is attached to a conventional boot binding system 12 mounted to the top 14 of the snowboard 110, and while the user is standing in and shuffling through a chair-lift line.

Figure 1B:
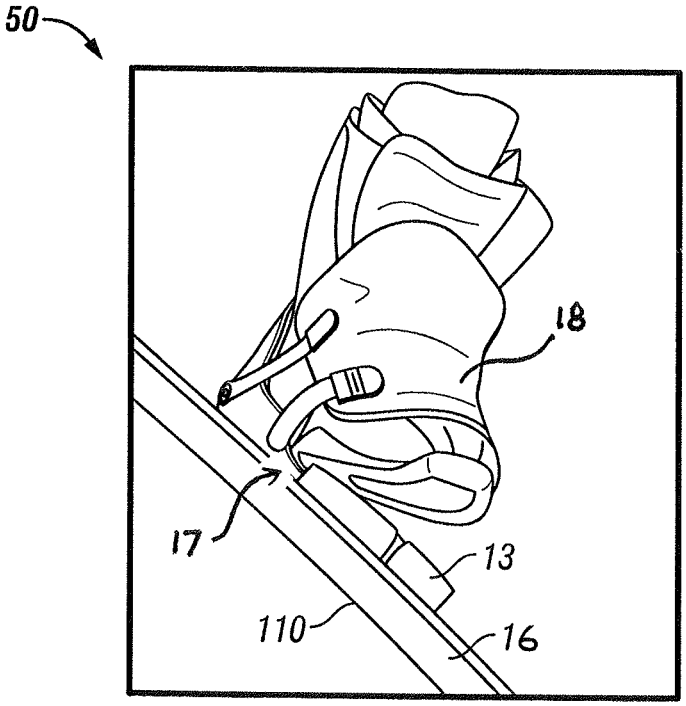
FIG. 1B (Prior Art)

Referring to the illustration 50 in FIG. 1B labeled as "Prior Art", the orientation of a user's boot 15 while riding chair lift and using prior art snowboard boot binding system 18 that incorporates a side hinge 17 is illustrated. The snowboard 110 is able to swing away from the base 13 of the binding system 18 to relieve some strain on a user's foot because of the side hinge 17; however, the user's boot is still fixed in its orientation perpendicular to a long edge 16 of the snowboard. The user may benefit from the singular side hinge but will still encounter pain and awkwardness when standing in chair-lift line because user's front boot is bound to the base of the snowboard 110 at an awkward angle (almost 90 degrees) with respect to the direction of the long edge 16 of the snowboard 110. Furthermore, the user will have to twist his foot perpendicular to the running direction of the long edge 16 upon chair dismount, which is additionally awkward to the user.

As depicted in FIG. 1B, position of user 50 while riding chairlifts is illustrated. The snowboard 110 with incorporated binding system 18 that allows a user's foot to bind to the snowboard 110. The position of user while riding chair lift may be uncomfortable and dangerous because the longitudinal axis of the user's front boot is substantially non-parallel to the longitudinal axis of the snowboard 110.

Figure 2:
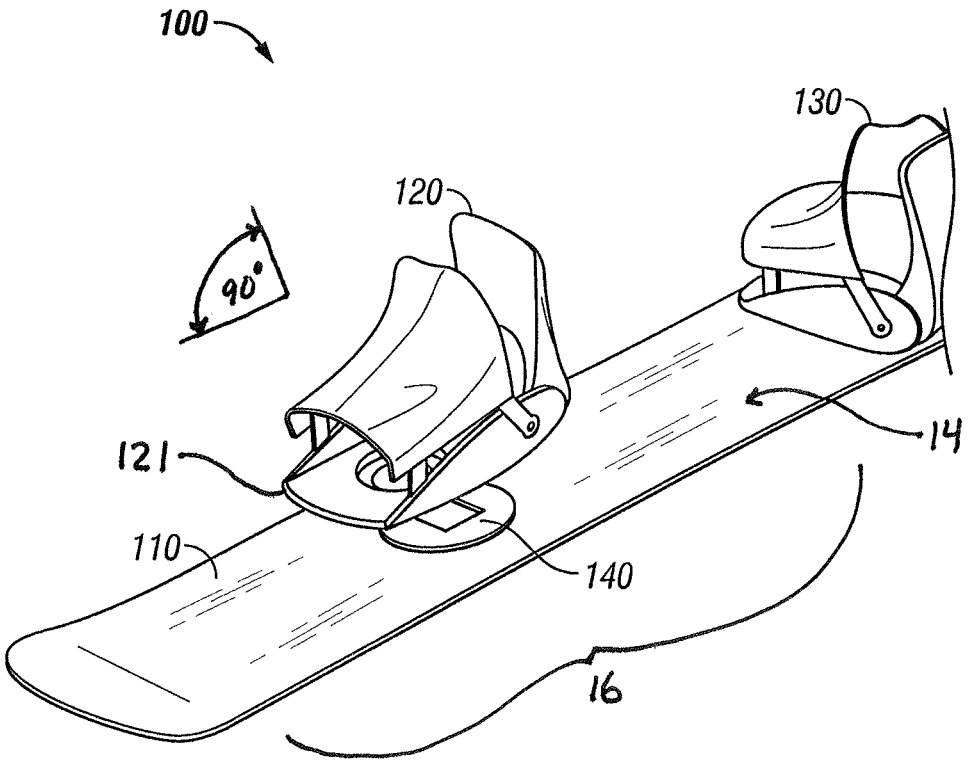
FIG. 2 illustrates a perspective view of a snowboard with a rotatable binding system which can be implemented in accordance with features of the present invention.

FIG. 2 illustrates a perspective view of a snowboard 100 with a rotatable binding system 121 which can be used to enable a snowboard user's first boot (not shown) for the user's lead foot to be secured by the harness 120 of the rotatable binding system 121 mounted to the top 14 of the snowboard 110, which can rotate up to 90 degrees on its base 140 with respect to the long edge 16 of the snowboard 110, thereby enabling the user's toes to face the leading tip of the snowboard 110 when the user is shuffling through a chairlift line. A user's second boot (trailing foot) can be secured by a fixed binding system 130 mounted to the top 14 of the snowboard 110. It is "fixed" meaning it is without any rotating action.

As is know in the art, a snowboard 110 is wide enough to accept two binding systems 121/130 that hold a user's feet apart from each other at a comfortable distance (slightly more than shoulder width apart) and the snowboard can be ridden down a sloped section of earth covered in snow while both of the user's feet are secured to the same board and while the user is facing perpendicular to the snowboard's long edge 16. Snowboarding is very different from skiing where a user has a dedicated ski attached to each foot and the skier is facing parallel to long edges of each ski (or facing the tips of the user's skis).

Hardware for the base of the rotatable binding system 121 can be made from a non-corrosive, light weight, and strong materials which include combinations of plastic, 01 tool steel, 6061 aluminum, and magnesium. It is known that the harness portions of the binding systems 120/130 are provided in various forms (e.g., including straps) and are typically made of durable plastics and nylon-based materials.

Figure 3A:
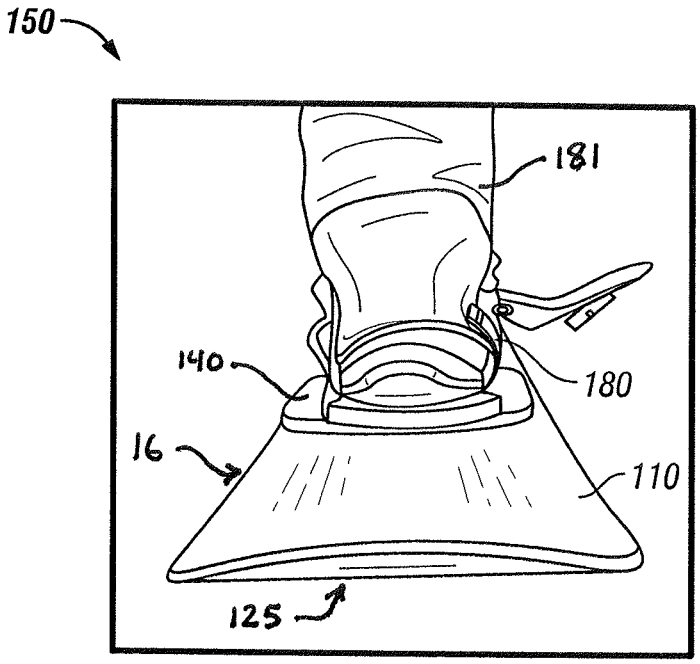
FIG. 3A illustrates an implementation of a rotational binding system incorporated on a snowboard and rotated to place a user's boot inline with the long edges of the snowboard while the user is standing in the chair-lift line, in accordance with a feature of the present invention.

FIG. 3A illustrates an implementation of a rotational binding system 150 wherein a base plate 140 and associated binding 180 are mounted on the top of the snowboard 110. The position of the user's foot 181 when standing in the chair-lift line using the rotational snowboard system 150 depicted in FIG. 3A is parallel to the long edge 16 of the snowboard 110, and facing the tip 125 of the snowboard 110. A snowboard 110 incorporating a rotatable binding system enables a user to bind his/her feet to the snowboard 110 and rotate the binding and foot in the direction of the snowboard's direction of travel while shuffling through a chair lift line. Hence, the position of a user while standing in a chair-lift line may be more comfortable because the user's front boot is bound to the snowboard 110 at a desirable angle. During downhill use, however, the binding can be locked into a position that is mostly perpendicular to the long edge 16 and tip 125 of the snowboard 110.

Figure 3B:
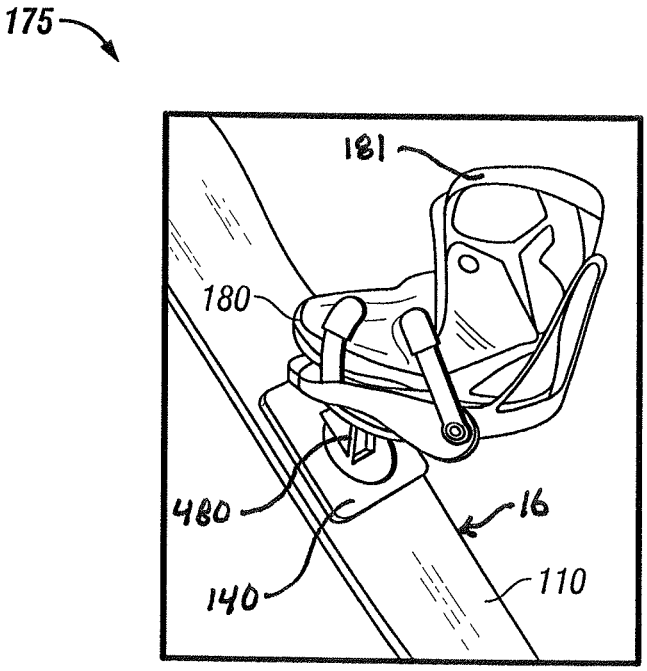
FIG. 3B illustrates a rotational binding system that also incorporated a double-hinged system connecting the base and top plate to enable the snowboard to be carried more comfortably by the user while riding a chair lift, in accordance with a feature of the present invention.

A hinged, rotatable binding system 175 is illustrated in FIG. 3B. As depicted in FIG. 3B, the position of the snowboard with a hinged rotatable binding system 175 on a user while riding on a chairlift is in the direction of travel with the board swung away at the base plate 140 from the top plate (shown and described in more detail in FIG. 6) is incorporated at the bottom of the harness system carrying the user's lead foot given a double hinge 480 attaching the base plate 140 and the top plate at the bottom of the boot harness 180. The snowboard 110 incorporating features of a hinged, rotatable binding system 175 will benefit from comfort while shuffling through a chair lift line and also while riding a chairlift because the binding system enables the user's foot to be rotated up to 90 degrees with respect to the user's original "riding" position on the snowboard 110 and also allows most of the force or pressure from the weight of the snowboard to be relieved on the user foot as most of the snowboard can fall away from the bottom of the user's foot. The position of a user's bound foot while riding a chair lift may experience relief stress from ankle and knee stress because the longitudinal axis of the user's front boot remains substantially parallel to the ground beneath the chair and the user as opposed to being contorted to follow the top of the weighted snowboard.

Figure 4:
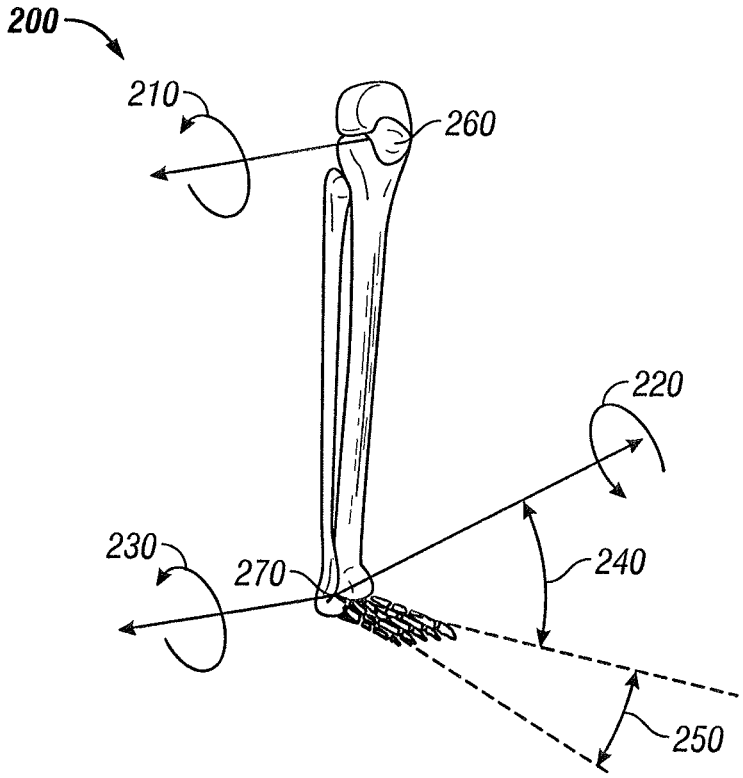
FIG. 4 illustrates an anatomic view of a human leg which illustrates the action of torque on knee and ankle which can be implemented in accordance with a feature of the present invention.

FIG. 4 illustrates an anatomic view 200 of a human ankle and knee where the binding system 200 reveals stress. The knee extension 210 as depicted in FIG. 4 is a three dimensional view of the extension provided to the human knee 260 by the binding system 200. The knee extension 210, which is in rotational upward direction, reveals the torque over the human knee 260. The ankle supination 220 is another three dimensional view of the supination provided to the human ankle 270 by the binding system. The ankle supination on the human ankle 270 tends towards downward direction. The angle of ankle supination 240 is the maximum supination that is provided by the binding system which can be an angle of forty-five degrees to the maximum as depicted in the FIG. 4. The ankle dorsiflexion 230 is a moment that decreases the angle between the foot and the leg. The medial rotation angle 250 of FIG. 4 is the maximum angle that is provided by the binding system, which can be an angle of twenty-three degrees to the maximum. Thus, the binding system alleviates the torque and moments on the human ankle 270 while on the lift.

Figure 5:
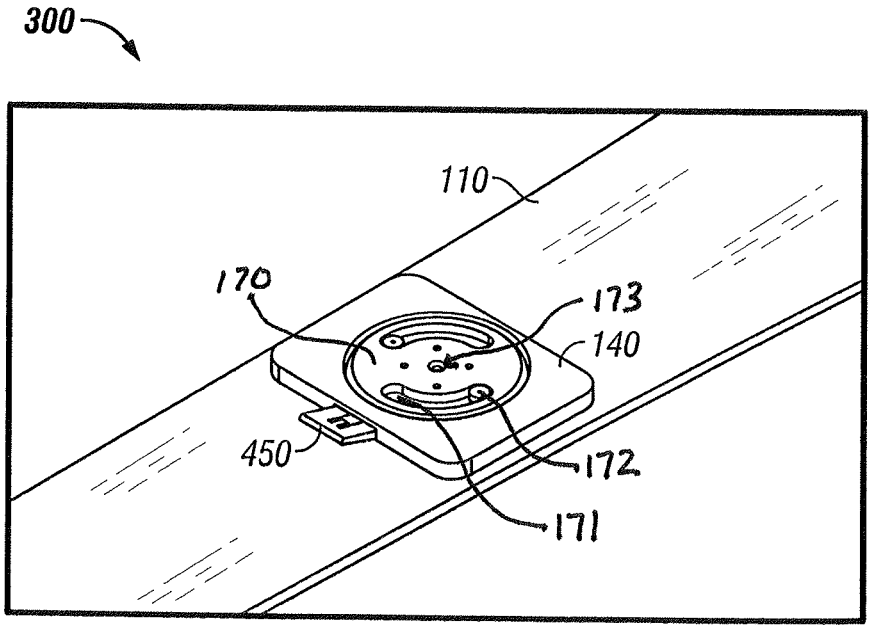
FIG. 5 illustrates a general view of the base plate and top plate of a rotatable snow binding assembly in accordance with features of the present invention.
Figure 6:
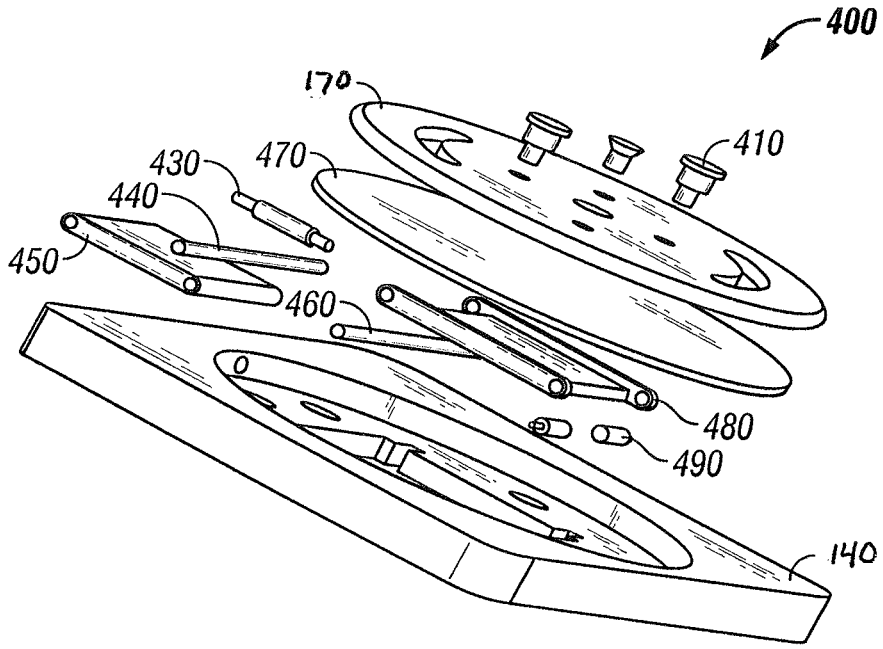
FIG. 6 illustrates an exploded view of the snowboard binding system which illustrates the parts involved in assembly of a rotatable snowboard binding system that also includes a double-hinged feature by connecting the base plate to a static plate (intermediary plate) that thereby rotatably secures the top plate, which can be implemented in accordance with a feature of the present invention.
Figure 9:
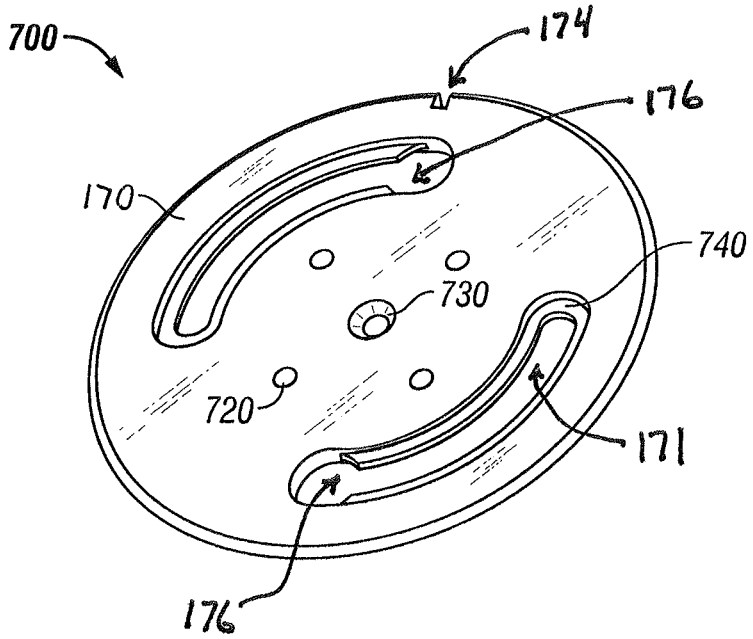
FIG. 9 illustrates a perspective view of the top plate as a rotating disk which can be attached either directly to the base plate by a center screw if hinged action is not implemented, or can be secured by a center screw at its center point to a mid static disk that connects to the base plate via a hinged plate and assembly, which can be implemented in accordance with a feature of the present invention.

FIG. 5 Illustrates the rotatable binding system assembly 300 for a snowboard. A base plate 140 can be mounted to the top 14 of a snowboard 110. The top plate includes a perimeter and a center wherein said center screw mounts the top plate to the center of the base plate 140. A top plate 170 can be rotatably mounted to the base plate 140 using a center screw 173. The binding system 300 can include a latch lever 450, which is a hand-free locking system through which the user can lock and unlock rotational action of the top plate 170 with respect to the base plate 140. The binding system 300 can include a number of bolts or screws (see item 410 as shown in FIG. 6) which can be used, for example, as the center screw to mount the top plate 170 to the base plate 140 at the center of the top plate 170, and can be used as the two retainers 172 used to limit rotation of the top plate 170 given the location of the retainers 172 within the curved slots 171 formed therein. Rotation of the top plate 170 can be limited by two curved slots 171 formed in the top plate between its center and perimeter and two retainers 172 mounted within the two curved slots. The two retainers 172 pass through the two curved slots 171 and can be attached to the bottom plate to further retain the top plate 170 to the bottom plate 140. The retainers 172 act as stops to further rotation of the top plate 170 when the ends of each curved slot 171 contact the fixed retainers 172. Referring to FIG. 9, the curved slots can be formed with a ledge 740 that act to further retain the top plate 170 onto the base plate 140 because the retainers, which can be screw-like (as shown in FIG. 6, item 410), can have a head, or tapered head, that rides on top of the ledge 740 formed within the curved slot 171, thereby keeping the top plate 170 more secure against the base plate 140, yet letting the top plate 170 rotate.

FIG. 6 illustrates an exploded view of a snowboard binding system 400 that illustrates the parts involved in assembly of a rotatable snowboard binding system that also includes a double-hinged feature (hinged, rotatable binding system) by connecting the base plate 140 to a static plate 470 (or intermediary plate) that the top plate 170 can be rotatably attached to. The top disk 170, when rotatably mounted to the base plate 140 can provide a rotational of up to 90 degrees to the user's lead foot on the snowboard. When hinging is incorporated into the binding system, a mid static disk 470 can be used to mount and support the rotation of the top disk 170. As discussed in FIG. 5, the top disk 170 can be rotatably mounted to the mid static disk 470 by a center screw. The mid static disk 470 can then be mounted to the base plate 140 by a double hinge system 480. Just as discussed in FIG. 5, this binding system 400 can include a number of bolts 410 which can be used, for example, as the center screw to mount the top plate 170 to the mid static plate 470 at the center of the top plate 170, and can be used as the two retainers 172 used to limit rotation of the top plate 170 given the location of the retainers 172 within the curved slots 171 formed therein.

A retractable plunger 430 can be mounted through the base plate 140 between the latch lever 450 and its retractable connection with a slot 174 formed by the top plate 170. The latch lever 450 is used to mount the outer ridge of the base plate 140 and can be connected to the retractable plunger 430. The upper dowel axis 440 can connect the hinge plate 480 with the mid static disk 470. The lower dowel axis 460 can connect the hinge plate 480 with the base plate 140. The connection linkage 490 can be used to connect the retractable plunger 430 with the latch lever 450. The base plate 140 can hold the entire assembly on it and is used to couple the binding system to the top plate 170, and ultimately with the snowboard 110.

Figure 7:
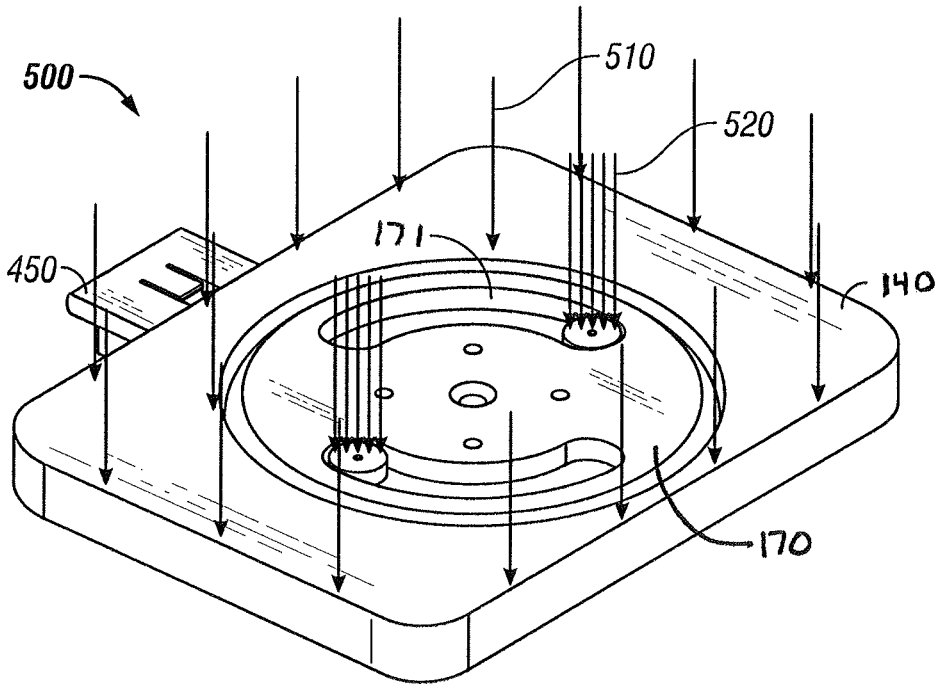
FIG. 7 illustrates an perspective view of the snowboard binding system with typical force distribution thereon, which can be implemented in accordance with a feature of the present invention.

FIG. 7 illustrates the force distribution and force application on the binding system 500. The force applied on the binding system 500 can be calculated by plotting on a three dimensional plane considering the axis of the planes as X-axis, Y-axis, and Z-axis. The base plate 140 of the binding system 500 can be sensed with a distributed force as such a force 510 as illustrated in the FIG. 5. The distributed force 510, which is applied on the base plate 140 is 0 along both X-axis and Y-axis and 2752 on the Z-axis. An even force 520 can be experienced by the top rotating plate 170 of the binding system 500. The even force 520 along X-axis and Y-axis is 0 and 2752 on the Z-axis. The force sensed by the latch lever 450 of the binding system 500 can be zero. There is no force acting on the binding system 500 in either X-axis or Y-axis, thus, the user can feel comfortable using the binding system 500.

Figure 8:
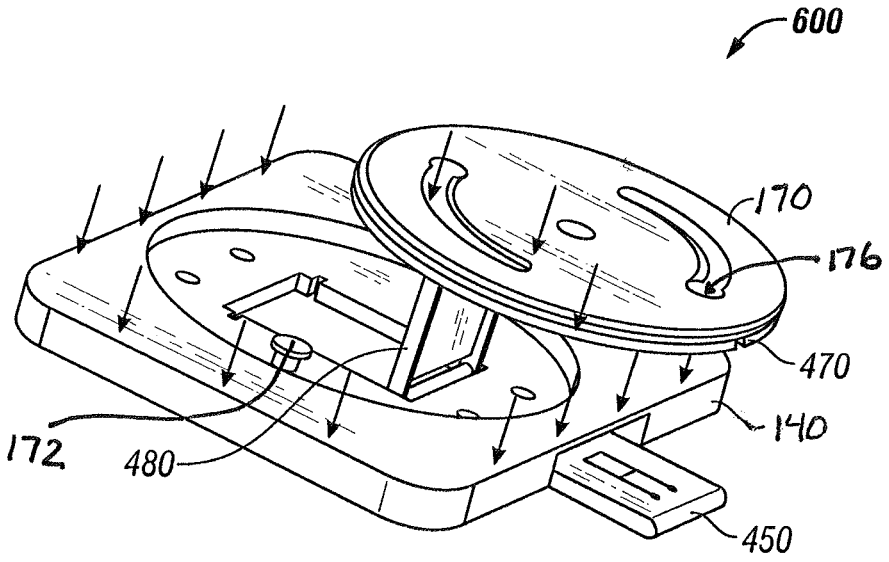
FIG. 8 illustrates a perspective view of a base plate connected by the hinge plate to a static disk, the static disk rotatably attached to and supporting a top rotating disk, which can be implemented in accordance with a feature of the present invention.

FIG. 8 illustrates a perspective view of binding system 600 of which the base plate 140 is connected by the hinge plate 480 to the mid static disk 470, supporting a top plate 170. FIG. 9 illustrates the perspective view of the top plate 170. The center point 730 is used to attach the top plate 170 with the mid static disk 470. Boot binding harness mounting holes 720 are shown in a four-bolt pattern and are used to secure the boot mounting hardware (e.g., straps, harness) to the top plate 170. The number of holes 720 used to couple the boot binding harness to the binding system can vary, but are typically in three or four hole patterns. The base plate 140 of the binding system can be connected by the hinge plate 480, either directly or through a mid static disk 470, supporting the rotating disk thereon. The latch lever 450 can be attached to side of the base plate 140.

Just as discussed in FIGS. 5 and 6, this binding system 600 can include a number of bolts 410 which can be used, for example, as the center screw to mount the top plate 170 to the mid static plate 470 at the center of the top plate 170, and can be used as the two retainers 172 used to limit rotation of the top plate 170 given the location of the retainers 172 within the curved slots 171 formed therein. However, as shown in FIG. 8, the retainers can be mounted to the base plate 140, which then requires that the mid static disk 470 and top plate 170 can allow the retainers to slip through them as they are separated from the base plate 140. This is accomplished by forming a hole in the mid static disk 470 that enables the retainers to pass through and also forming a passage area 176 at one end of the curved slot 171 that allows the retainers to pass through the top plate 170 past the ledge 740 formed in the curved slots 171. When the top plate is rotated to normal operating position, the retainers 172 ride on top of the ledge thereby retaining the mid static disk and top plate against the base plate 140 (and presumably in locked position). By comparison, when the top plate 170 is rotated the opposite direction up to 90 degrees, the mid static disk 470 and top plate 170 can separate from the base plate 140 because of the holes and passage areas formed in the mid static disk 470 and top plate 170, respectively.

The displacement of the binding system is concentrated on the base of the top disk. The base of the binding system can withhold a maximum displacement of +4.0403E-06. The maximum displacement that is provided at the latch lever 450 can be 6.515E-06 in. The maximum von Mises stress, which is the stress at which the binding system 600 begins to deform, can be 417.6 psi. The binding system can withhold a high von Mises stress, thus, it can be durable and provide force capabilities.

Figure 10:
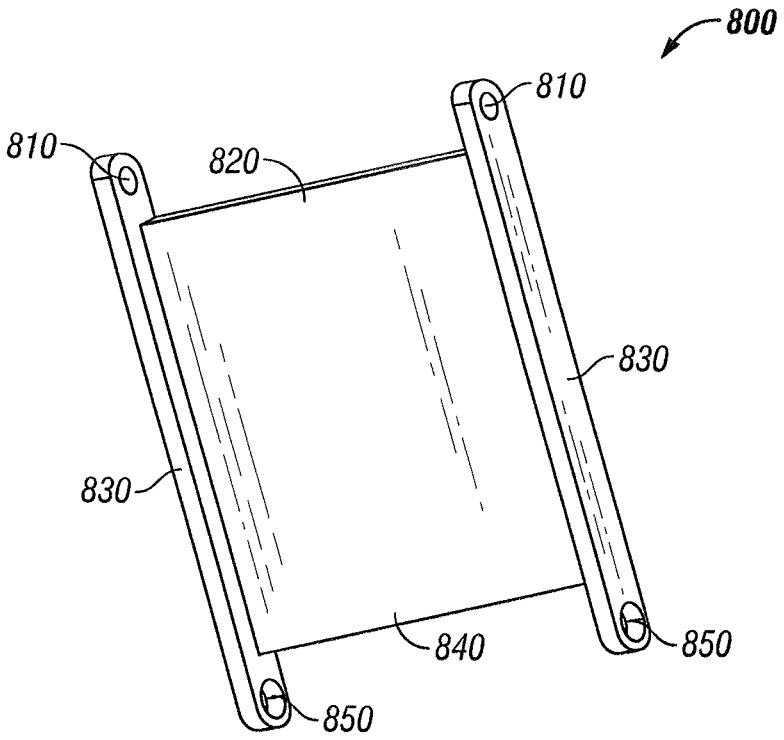
FIG. 10 illustrates a perspective view of a supporting hinge plate that enables double hinge action and connects the base plate with the mid static disk when hinged action is desired, which can be implemented in accordance with a feature of the present invention.

FIG. 10 illustrates the perspective view of a hinge plate 800. The hinge plate 800 enables a double hinge action and connects the base plate 140 with the mid static disk 470. The hinge plate 480 includes a pair of top holes 810 used to connect with the mid static disk 470. The hinge plate 480 includes a pair of bottom holes 850 that is used to connect it with the base plate 140. The top hole 810, the bottom hole 850, and the outer ridge 830 are the regions of the hinge plate 480 where the maximum von Mises stress is applied. The upper part 820 of the hinge plate 480 and the lower part 840 of the hinge plate 480 are the regions where the von Mises stress can be minimized. The minimized stress extends the durability of the hinge plate 800.

The binding system 100 is provided with the hinge plate 800 and a number of friction plates, therefore fewer parts are needed. The materials used in the snowboard binding system 100 are preferably non-corrosive, light-weight, strong, and durable. The hinged rotatable binding system 100 for snowboards 110 is cost effective and a light-weight model with simple assembly features.

Figure 11:
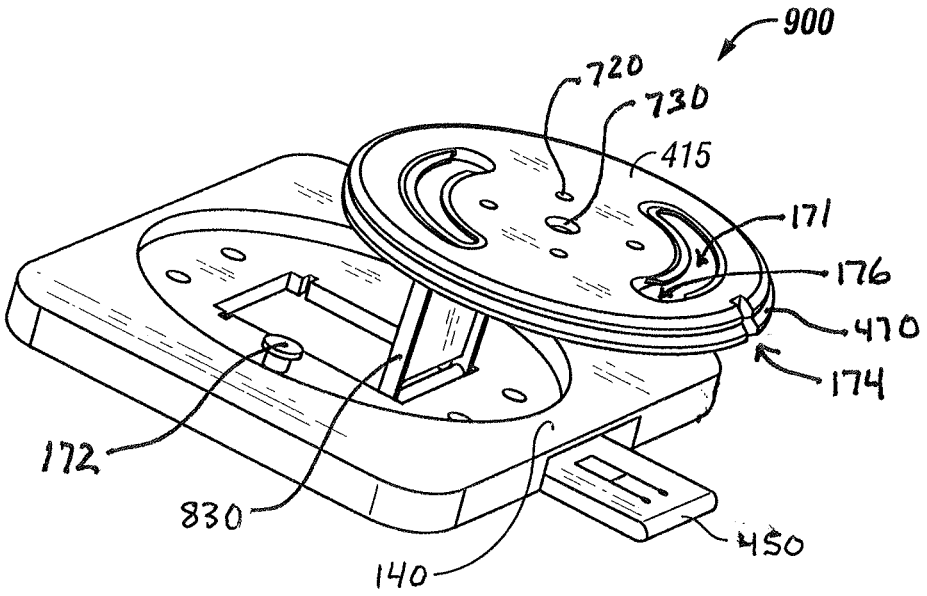
FIG. 11 illustrates a top view of the hinged, rotatable binding system shown fully released when the latch lever is activated to release a spring loaded plunger enabling the top plate to rotate and separate from the base plate, in accordance with a feature of the present invention.

FIG. 11 illustrates a perspective view of the hinged, rotatable binding system 900 shown with center mounting hole 730 and boot binding hardware mounting holes 720. Also shown is a notch 174 formed in both the top plate 170 and the mid static disk 470. The notch serves to lock the top plate from rotation, and it can be formed in both of the top plate 170 or mid static disk 470, but must lock rotation of the top plate at a minimum; therefore, it will likely be located at least in the top plate 170 for interaction with the locking mechanism actuated by the lever 450.

Aspects of the snowboard binding systems can be made of various materials including 01 tool steel, 6061 aluminum, and magnesium that are used in the snowboard binding systems whose tensile strength, yield strength, and density are as mentioned in the following table:

| Material | Tensile Strength | Yield Strength | Density |
|---|---|---|---|
| 01 Tool Steel | 84,000 psi | 70,000 psi | .31 lb/in$^3$ |
| 6061 Aluminum | 45,000 psi | 40,000 psi | .098 lb/in$^3$ |
| Magnesium | 34,000 psi | 23,000 psi | .065 lb/in$^3$ |

It is believed that utilizing the system described herein relieves knee and ankle pain for snowboarders while in lift lines and on the chair lift. The system described herein can also be adapted for rotating the front binding to a parallel position and to reduce discomfort and injury when loading/unloading from a chairlift.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A binding system for a snowboard, the snowboard having a top side, a bottom side to slide on snow, a first end and a second end, long edges separating the first end and the second end, and the binding system to support a person by attaching both of the person's feet to the top side, the binding system for the snowboard including:

a rotatable binding mountable to the top side of the snowboard near the first end, the rotatable binding further comprising;

a base plate mountable to the snowboard by screws;

a top plate rotatably attached to the base plate by a center screw;

a first boot binding harness mounted to the top plate;

a latching mechanism that selectively locks and releases rotation of the top plate with respect to the bottom plate; and a hinge plate serving as coupling between the base plate and the top plate and wherein said hinge plate directly connects to the base plate and a mid static disk, and the top plate is rotatably attached to the mid static disk that supports rotation of said top plate with respect to the base plate; and a fixed binding including a second boot binding harness mountable to the top side of the snowboard between the second end and the rotatable binding in a manner that will keep a second boot contained within the second boot binding harness mostly perpendicular to the long edges of the snowboard;

wherein said first and second boots contained within the first and second boot binding harnesses are mostly parallel to each other during use of the snowboard by the person with feet of the person contained in the boots while descending down a snow covered hillside, and wherein said rotatable binding is moveable to a position mostly perpendicular to said fixed binding and parallel with the long edges when the person has only the first boot mounted to the snow board on said rotatable binding and the person shuffling through a line by pushing on snow covered ground with the second boot while it is not secured by the fixed binding.

2. The binding system for a snowboard of claim 1, wherein the latching mechanism further comprises a lever mounted to an edge of said base plate and connected to a retractable plunger using a retractable connection to the top plate, wherein said latch lever acts as a locking and release system for maintaining said top plate in a locked position on the base plate thereby keeping the first boot contained within the first boot binding harness mostly perpendicular to the long edges of the snowboard or releasing said top plate for rotation up to a 90 degrees with respect to said base plate thereby placing the first boot mostly parallel to the long edges of the snowboard and facing the first end.

3. The binding system for a snowboard of claim 1, wherein said hinge plate further enables double hinge movement of said boot binding harness away from said snowboard at a toe area of the boot binding harness.

4. The binding system for a snowboard of claim 1, further comprising at least one retainer, wherein said top plate includes a perimeter and a center wherein said center screw mounts the top plate to the bottom plate, and wherein said top plate has at least one curved slot formed through the top plate between the center and the perimeter, wherein the at least one retainer passes through the at least one curved slot and are attached to the bottom plate to allow the at least one curved slot to move along the at least one retainer and limit movement of the top plate to a length of the at least one curved slot, and wherein the at least one retainer further retain the top plate to the bottom plate given the fixed position of the at least one retainer within the at least one curved slot.

5. The binding system for a snowboard of claim 1, further comprising at least one retainer having a tapered head, wherein said top plate includes a perimeter and a center, and wherein said top plate has at least one curved slot formed through the top plate between the center and the perimeter including a ledge formed within the at least one curved slot up to a passage area formed at one end of the at least one curved slot, the passage area large enough for the tapered head to pass through at one end of the at least one curved slot and the ledge creates a slot that is narrower than the tapered head, and wherein the mid static disk has at least one hole formed therein to allow the at least one retainer to pass through the mid static disk, wherein the at least one retainer also passes through the passage area formed at the one end of the at least one curved slot and is attached to the bottom plate to allow the at least one curved slot to move along the at least one retainer beneath the tapered head and limit movement of the top plate to a length of the at least one curved slot, and wherein the at least one retainer further retains the top plate to the bottom plate given the fixed position of the at least one retainer along the at least one curved slot at locations away from the passage area while the tapered head is located over the ledge formed within the at least one curved slot.

6. The binding system for a snowboard of claim 1, further comprising a spring plunger mounted through said base plate by a latch lever in retractable connection with a slot formed in the top plate wherein said latch lever is mounted on an edge of said base plate for locking and unlocking the rotatable binding system via said spring plunger.

7. The binding system for a snowboard of claim 1, further comprising a latch lever mounted on an edge of said base plate wherein said latch lever is further connected to a spring plunger to enable retraction of said spring plunger from engagement with said top plate, wherein said top plate allows the person to rotate the rotatable binding up to ninety degrees with respect to said base plate to a parallel position with respect to the side edge of the snowboard for ease of snowboarder mobility when shuffling along in a chairlift line.

8. A binding system for a snowboard, the snowboard having a top side, a bottom side to slide on snow, a first end and a second end, long edges separating the first end and the second end, and the binding system to support a person by attaching both of the person's feet to the top side, the binding system for the snowboard including:

a rotatable binding mountable to the top side of the snowboard near the first end, the rotatable binding further comprising;

a base plate having an outer ridge and mountable to the snowboard by screws;

a top plate rotatably attached to the base plate by a center screw;

a first boot binding harness mounted to the top plate;

a latching mechanism that selectively locks and releases rotation of the top plate with respect to the bottom plate; and a hinge plate serving as coupling between the base plate and the top plate and wherein said hinge plate directly connects to the base plate and a mid static disk, and the top plate is rotatably attached to the mid static disk that supports rotation of said top plate with respect to the base plate; and a fixed binding including a second boot binding harness mountable to the top side of the snowboard between the second end and the rotatable binding in a manner that will keep a second boot contained within the second boot binding harness mostly perpendicular to the long edges of the snowboard.

9. The binding system for a snowboard of claim 8, wherein said first and second boots contained within the first and second boot binding harnesses are mostly parallel to each other during use of the snowboard by the person with feet of the person contained in the boots while descending down a snow covered hillside, and wherein said rotatable binding is moveable to a position mostly perpendicular to said fixed binding and parallel with the long edges when the person has only the first boot mounted to the snow board on said rotatable binding and the person is shuffling through a chairlift line or riding on a chairlift by pushing on snow covered ground with the second boot while it is not secured by the fixed binding.

10. The binding system for a snowboard of claim 8, wherein the latching mechanism further comprises a lever mounted to an outer ridge of said base plate and connected to a retractable plunger using a retractable connection to the top plate, wherein said latch lever acts as a locking and release system for maintaining said top plate in a locked position on the base plate thereby keeping the first boot contained within the first boot binding harness mostly perpendicular to the long edges of the snowboard or releasing said top plate for rotation up to a 90 degrees with respect to said base plate thereby placing the first boot mostly parallel to the long edges of the snowboard and facing the first end.

11. The binding system for a snowboard of claim 8, wherein said hinge plate further enables double hinge movement of said boot binding harness away from said snowboard at a toe area of the boot binding harness.

12. The binding system for a snowboard of claim 8, further comprising at least one retainer, wherein said top plate includes a perimeter and a center wherein said center screw mounts the top plate to the bottom plate, and wherein said top plate has at least one curved slot formed through the top plate between the center and the perimeter, wherein the at least one retainer passes through the at least one curved slot and are attached to the bottom plate to allow the at least one curved slot to move along the at least one retainer and limit movement of the top plate to a length of the at least one curved slot, and wherein the at least one retainer further retain the top plate to the bottom plate given the fixed position of the at least one retainer within the at least one curved slot.

13. The binding system for a snowboard of claim 8, further comprising at least one retainer having a tapered head, wherein said top plate includes a perimeter and a center, and wherein said top plate has at least one curved slot formed through the top plate between the center and the perimeter including a ledge formed within the at least one curved slot up to a passage area formed at one end of the at least one curved slot, the passage area large enough for the tapered head to pass through at one end of the at least one curved slot and the ledge creates a slot that is narrower than the tapered head, and wherein the mid static disk has at least one hole formed therein to allow the at least one retainer to pass through the mid static disk, wherein the at least one retainer also passes through the passage area formed at the one end of the at least one curved slot and is attached to the bottom plate to allow the at least one curved slot to move along the at least one retainer beneath the tapered head and limit movement of the top plate to a length of the at least one curved slot, and wherein the at least one retainer further retains the top plate to the bottom plate given the fixed position of the at least one retainer along the at least one curved slot at locations away from the passage area while the tapered head is located over the ledge formed within the at least one curved slot.

14. The binding system for a snowboard of claim 8, further comprising a spring plunger mounted through said base plate by a latch lever in retractable connection with a slot formed in the top plate wherein said latch lever is mounted on an edge of said base plate for locking and unlocking the rotatable binding system via said spring plunger.

15. The binding system for a snowboard of claim 8, further comprising a latch lever mounted on an edge of said base plate wherein said latch lever is further connected to a spring plunger to enable retraction of said spring plunger from engagement with said top plate, wherein said top plate allows the person to rotate the rotatable binding up to ninety degrees with respect to said base plate to a parallel position with respect to the side edge of the snowboard for ease of snowboarder mobility when shuffling along in a chairlift line.

16. A binding system for a snowboard, the snowboard having a top side, a bottom side to slide on snow, a first end and a second end, long edges separating the first end and the second end, and the binding system to support a person by attaching both of the person's feet to the top side, the binding system for the snowboard including:

a rotatable binding mountable to the top side of the snowboard near the first end, the rotatable binding further comprising;

a base plate mountable to the snowboard by screws;

a top plate rotatably attached to the base plate by a center screw;

a first boot binding harness mounted to the top plate;

a latching mechanism that selectively locks and releases rotation of the top plate with respect to the bottom plate, wherein the latching mechanism further comprises a lever mounted to an outer ridge of said base plate and connected to a retractable plunger using a retractable connection to the top plate, wherein said latch lever acts as a locking and release system for maintaining said top plate in a locked position on the base plate thereby keeping the first boot contained within the first boot binding harness mostly perpendicular to the long edges of the snowboard or releasing said top plate for rotation up to a 90 degrees with respect to said base plate thereby placing the first boot mostly parallel to the long edges of the snowboard and facing the first end; and a hinge plate serving as coupling between the base plate and the top plate and wherein said hinge plate directly connects to the base plate and a mid static disk, and the top plate is rotatably attached to the mid static disk that supports rotation of said top plate with respect to the base plate; and a fixed binding including a second boot binding harness mountable to the top side of the snowboard between the second end and the rotatable binding in a manner that will keep a second boot contained within the second boot binding harness mostly perpendicular to the long edges of the snowboard.

17. The binding system for a snowboard of claim 16, further comprising at least one retainer having a tapered head, wherein said top plate includes a perimeter and a center, and wherein said top plate has at least one curved slot formed through the top plate between the center and the perimeter including a ledge formed within the at least one curved slot up to a passage area formed at one end of the at least one curved slot, the passage area large enough for the tapered head to pass through at one end of the at least one curved slot and the ledge creates a slot that is narrower than the tapered head, and wherein the mid static disk has at least one hole formed therein to allow the at least one retainer to pass through the mid static disk, wherein the at least one retainer also passes through the passage area formed at the one end of the at least one curved slot and is attached to the bottom plate to allow the at least one curved slot to move along the at least one retainer beneath the tapered head and limit movement of the top plate to a length of the at least one curved slot, and wherein the at least one retainer further retains the top plate to the bottom plate given the fixed position of the at least one retainer along the at least one curved slot at locations away from the passage area while the tapered head is located over the ledge formed within the at least one curved slot.

* * * * *